US008275429B1

(12) United States Patent
Pourrahimi et al.

(10) Patent No.: US 8,275,429 B1
(45) Date of Patent: Sep. 25, 2012

(54) HIGH MAGNETIC FIELD GRADIENT STRENGTH SUPERCONDUCTING COIL SYSTEM

(75) Inventors: Shahin Pourrahimi, Brookline, MA (US); Nadder Pourrahimi, Waltham, MA (US); William Frederick Punchard, Sudbury, MA (US); Piotr Marian Starewicz, Somerville, MA (US)

(73) Assignee: Stern Magnetics, LLC, Billerica, MA (US)

( * ) Notice: Subject to any disclaimer, the term of this patent is extended or adjusted under 35 U.S.C. 154(b) by 27 days.

(21) Appl. No.: 13/083,020

(22) Filed: Apr. 8, 2011

Related U.S. Application Data

(60) Provisional application No. 61/321,981, filed on Apr. 8, 2010.

(51) Int. Cl.
*H01B 12/00* (2006.01)

(52) U.S. Cl. ..... 505/211

(58) Field of Classification Search ..... 505/211, 505/879; 335/216
See application file for complete search history.

(56) References Cited

U.S. PATENT DOCUMENTS

| | | | | |
|---|---|---|---|---|
| 2010/0267567 | A1* | 10/2010 | Overweg et al. | 505/163 |
| 2011/0012599 | A1* | 1/2011 | Gao et al. | 324/318 |
| 2011/0074411 | A1* | 3/2011 | Tomoda et al. | 324/307 |
| 2011/0271693 | A1* | 11/2011 | Jiang et al. | 62/47.1 |
| 2011/0284191 | A1* | 11/2011 | Jiang | 165/135 |
| 2012/0068795 | A1* | 3/2012 | Wu et al. | 335/216 |
| 2012/0108433 | A1* | 5/2012 | Jiang et al. | 505/163 |
| 2012/0118630 | A1* | 5/2012 | Jiang et al. | 174/74 R |

* cited by examiner

*Primary Examiner* — Colleen Dunn
(74) *Attorney, Agent, or Firm* — Law Office of Herbert A. Newborn

(57) ABSTRACT

High magnetic field gradient strength superconducting coil systems for use in medical applications are provided. Systems capable of providing time-varying gradient magnetic field strength greater than 50 mT/m, over a spherical volume with a diameter greater than 20 centimeters include superconducting gradient coils and a heat conduction assemblage in physical contact with each coil.

24 Claims, 4 Drawing Sheets

HIGH MAGNETIC FIELD GRADIENT STRENGTH SUPERCONDUCTING COIL SYSTEM

CROSS-REFERENCE TO RELATED APPLICATION(S)

This application claims priority from U.S. Provisional Patent Application Ser. No. 61/321,981, filed Apr. 8, 2010, which is incorporated herein by reference.

TECHNICAL FIELD

The present invention relates generally to AC superconducting coils designed to generate time-varying gradient magnetic fields. More specifically, it relates to the thermal management of these coils to insure their superconducting operation.

BACKGROUND ART

Numerous techniques, particularly in the medical field, to improve not only diagnostics, as MRI systems achieved, but to use magnetics in proactive disease intervention and cure are being studied. Several proposed techniques involve magnetic propulsion of magnetic objects through the bloodstream or other anatomical structures. For such applications, sets of electromagnet type coils that can generate three axis orthogonal gradient magnetic fields are useful to propel the magnetic objects in various directions. High magnetic propulsion forces can be generated by electromagnet type coils that generate high magnetic gradients. Superconducting gradient coils (SGC) are of interest because they can produce higher gradient field strength, therefore higher propulsion forces, than are practically possible using copper coils. Typically, sets of electromagnet type coils that generate gradient magnetic fields are called gradient coils. Gradient magnetic fields are commonly called gradient fields. Three axis gradient coils are used in Magnetic Resonance Imaging (MRI) scanners, as well as Nuclear Magnetic Resonance (NMR) spectrometers. Higher gradient fields are useful to some applications including diffusion weighted imaging and high resolution imaging.

An electromagnet type coil that uses superconducting wire, or cable of superconductive wires, is called a superconducting coil. Superconducting wires transport electric current without resistance. A superconducting coil or magnet may be wound with unitary wire or with a cable containing superconducting wires (either are herein denoted superconducting conductors). A DC magnet that uses a superconducting conductor produces no heat so long as the magnet is kept below its critical temperature, $T_C$. However, since in many applications gradient coils are pulsed (i.e. they are charged by alternating current (AC)), the superconducting conductors making up an AC superconducting magnet generate significant heat as the result of so-called AC losses. This heat if unmanaged and not removed from the vicinity of the pulsing SGC will quickly lead to a temperature rise and the loss of superconductivity. AC losses in practical superconductors are generated by three main mechanisms: 1) hysteresis, 2) eddy current, and 3) coupling. Hysteresis losses can be reduced by using wires with fine superconducting filaments (i.e. multifilamentary wires.) Eddy current losses can be reduced by decreasing the length of the current paths through the normal conductivity materials resident in the cross-section of the superconductive wire. Coupling losses can be reduced by using a matrix of relatively high resistivity material (e.g. Cu—Ni or Cu—Sn (bronze)) between the superconducting filaments, and by twisting the wire as tightly as possible. Therefore a superconducting wire for an AC application would have fine filaments, preferably less than 10 micrometer in thickness, would be twisted, preferably with a twist pitch tighter than 1 turn per 5 cm, would have inter-filament material matrix that has high resistivity, and copper stabilizer that is configured to reduce eddy current paths. A feasible conductor for an AC superconducting magnet might be a cable of relatively fine superconducting wires with attributes described above. A cable composed of fine wires: a) allows tighter twisting of the individual wires, b) creates relatively shorter eddy current paths because of the smaller diameter, c) facilitates the wire manufacturing process for creating fine superconducting filaments, and d) increases the effective twist pitch because after twisting the individual wires, the overall cable is twisted as well.

Practical engineering (both universal and application-specific) problems associated with the substitution of SGC-based systems for copper gradient coil systems remain. A universal one is that since losses inherent in the generation of time-varying fields are inevitable, the resultant heat generated from such losses must, with adequate thermal management, be removed from the SGC region. This universal problem along with other issues associated with, for example, the detrimental coupling of the time varying fields of an SGC with instruments in its vicinity (e.g. the so-called $B_0$ DC superconducting magnet within which the SGC system may be required to operate) are addressed in this disclosure.

SUMMARY OF THE INVENTION

A system capable of generating time-varying gradient magnetic field strength greater than 50 mT/m over a spherical volume with a diameter greater than 20 centimeters is provided in an embodiment. The system includes a plurality of gradient coils, each comprising superconductive conductors that, above a critical temperature $T_C$, exhibit electrical resistance; and a heat conduction assemblage, a portion of the assemblage in physical contact with each coil. Heat generated in association with the time-varying gradient magnetic field is capable of being conducted through the assemblage and away from the wires to achieve a steady-state system temperature below $T_C$ and thereby maintaining the conductors in a superconducting state. The system may have three mutually orthogonal gradient coils. The system may also have three shielding coils, such that each gradient coil has a shielding coil associated with it, thereby defining three mutually orthogonal shielded gradient coils. The heat conduction assemblage may include a plurality of composite bobbins, each composite bobbin may have a gradient coil associated therewith; each composite bobbin in physical contact with its associated gradient coil; each bobbin made from an array of thermally conductive elements disposed within an electrical insulator. The assemblage further has a thermally conductive mass in physical contact with the bobbins at a distance from the coils. In another embodiment, the system may have three mutually orthogonal gradient coils and three shielding coils, such that each gradient coil has a shielding coil associated with it, thereby defining three mutually orthogonal shielded gradient coils, wherein the plurality of composite bobbins comprises three composite bobbins, one associated with each of the mutually orthogonal gradient coils. In this embodiment, the system also has three shielding coil composite bobbins (making a total of six bobbins altogether), each having a shielding coil associated therewith, each shielding coil composite bobbin in physical contact with its associated shielding coil each shielding coil composite bobbin comprising an array of thermally conductive elements disposed within an electrical insulator, such that the thermally conductive mass is also in physical contact with the shielding coil bobbins at a distance from the shielding coils.

In another embodiment, the thermally conductive elements are Litz wire, or cables. In yet another, the thermally conductive elements are sapphire. The thermally conductive material may be of sufficient length to integrally extend from the gradient coil to the mass The time-varying gradient magnetic field strength may be greater than 200 mT/m or even greater than 500 mT/m. The superconductive conductors may comprise an A15 compound or may, more specifically, be $Nb_3Sn$. The $Nb_3Sn$ containing wires (hereafter called $Nb_3Sn$ wires) may be twisted and be from a class that is commonly known as multifilamentary; the filaments may have a maximum diameter of about 10 microns. The $Nb_3Sn$ wires may have an electrical insulating coating having a coating thickness of between 0.01 and 0.05 millimeters. In yet another embodiment, the system may have a mechanical cryocooler in thermal communication with the heat conduction assemblage, the cryocooler capable of absorbing heat being conducted away from the gradient coils to achieve a steady-state system temperature below $T_C$ and thereby maintain the wires in a superconducting state.

In a further embodiment, a system capable of generating time-varying gradient magnetic field strength greater than 50 mT/m, over a spherical volume with a diameter greater than 20 centimeters, is provided. The system has three mutually orthogonal shielded gradient coils, each comprising twisted multifilamentary $Nb_3Sn$ A15 compound wires that, above 16K, exhibit electrical resistance, three composite bobbins, each composite bobbin in physical contact with an associated gradient coil, each bobbin comprising an array of thermally conductive elements disposed within an electrical insulator, three shielding coil composite bobbins, each shielding coil composite bobbin in physical contact with an associated shielding coil, each shielding coil bobbin comprising an array of thermally conductive elements disposed within an electrical insulator, a thermally conductive mass in physical contact with the bobbins at a distance from the coils, and a mechanical cryocooler in thermal communication with the mass, the cryocooler capable of absorbing heat being conducted away from the shielded gradient coils to achieve a steady-state system temperature below 16K and thereby maintaining the wires in a superconducting state. The system may have thermally conductive materials that are Litz cables. In yet another, the thermally conductive material is sapphire. The time-varying magnetic field strength may be greater than 200 mT/m or even greater than 500 mT/m.

In yet another embodiment, a magnetic propulsion and imaging system including many of the system embodiments previously disclosed is provided.

BRIEF DESCRIPTION OF THE DRAWINGS

FIG. 2(*a*) illustrates use of sapphire as a thermal conductor; FIG. 2(*b*) illustrates use of Litz cable as a thermal conductor.

DETAILED DESCRIPTION OF EXEMPLARY EMBODIMENTS

Figure 1:
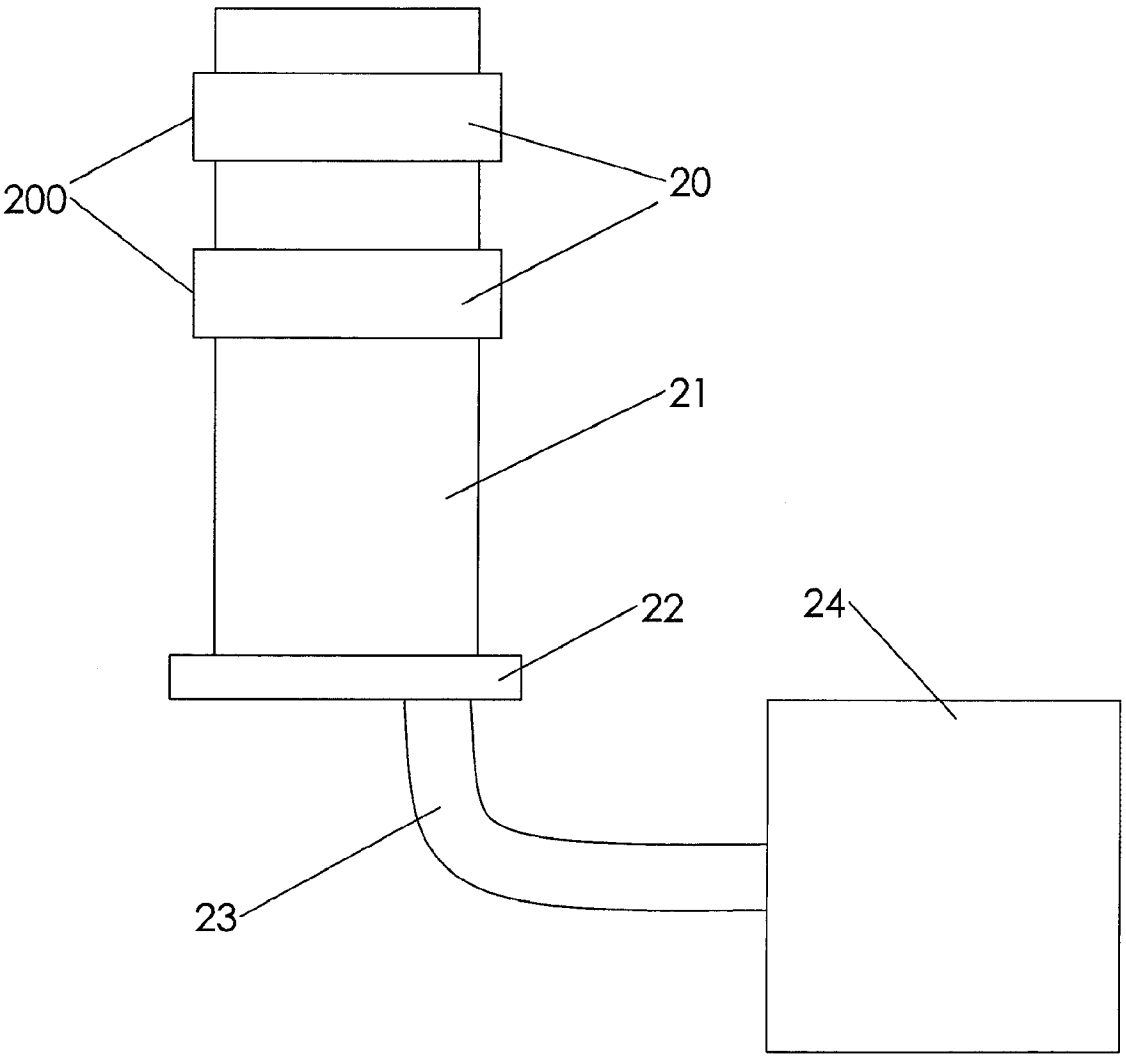
FIG. 1 is a schematic representation of a superconducting gradient coil system including SGC coils and an associated heat conduction assemblage in accordance with an embodiment.

FIG. 1 depicts a thermal management arrangement suitable for an SGC system. It is understood that all figures and related descriptions of all embodiments focus mainly on factors that substantially affect the thermal management of an SGC system. Other components necessary to ensure mechanical requirements of operation of an SGC are not shown or discussed. Furthermore, although the figures and descriptions of all disclosed embodiments depict and emphasize essentially cylindrical system configurations, other systems configuration types and dimensionalities are to be considered to be included within the spirit of the present invention. Coils 20, when pulsed, and not cooled properly, generate heat sufficient to, with time, raise the local temperature above T, of the superconductive wire. Note that coils 20 as shown are so-called Z-axis solenoid windings upon bobbin 21. It is to be understood that saddle shaped X-coils and Y-coils (not shown) are also needed to create a three-dimensional SGC system and would be cooled in a similar fashion. Heat sinking of the coils 20 to a cryocooler 24 is preferred over immersion in a liquid cryogen. It is believed that an unacceptably large volume of liquid helium would need to be contained and replenished to pulse coils 20 at higher than 1 Hz and generate gradient field strength of higher than a few hundred mT/m over a diametrically spherical volume (the DSV is a region located at the geometric center of the SGC system) of 20 centimeters while maintaining the coils in superconducting state. If bobbin 21 were to be made from electrically conductive material, bobbin 21, being exposed to a time-varying magnetic field, would be subject to eddy currents that in turn would generate heat within bobbin 21. It is advantageous to limit or eliminate heat being generated by bobbin 21.

Figure 3:
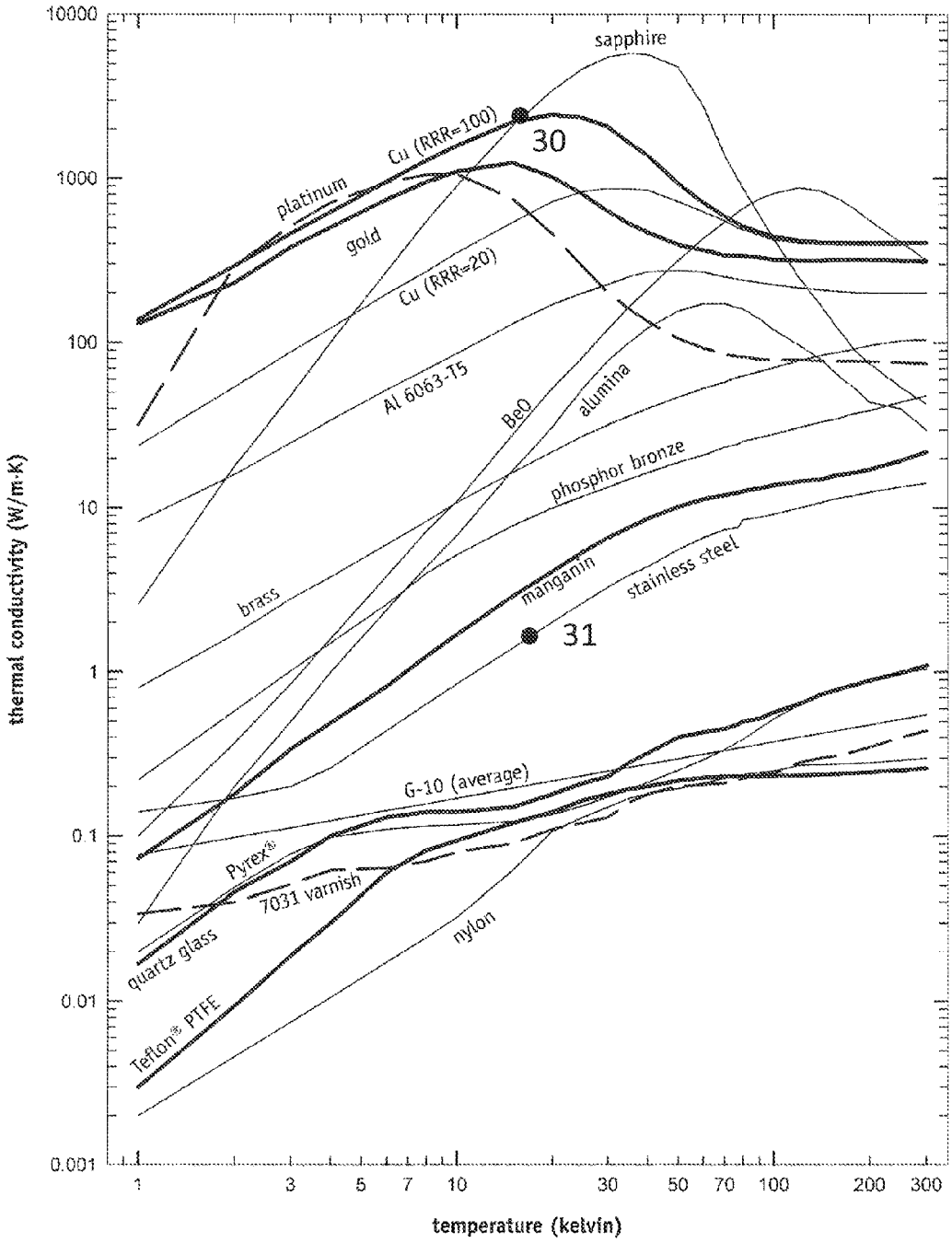
FIG. 3 is a graph of thermal conductivity vs. temperature for various materials.

If bobbin 21 is to function efficiently within this system, it would be advantageous for the bobbin to be adequately thermally conductive along its length while remaining electrically insulating in the direction that is transverse to its length This combination can be achieved by assembling an array of thermally conductive elements disposed within an electrical insulator (i.e. a composite bobbin). As the heat flow rate is a strong function of the length of the heat conduction path, continuous heat conducting members aligned in the direction of desired heat flow are preferred for this task. FIG. 3 graphs the thermal conductivity of selected materials at the cryogenic temperatures of interest. For the purpose of defining in this disclosure which materials are thermally conductive, lower limit point 31, approximately 1 W/mK (or the approximate thermal conductivity of stainless steel) shall define the bounds of thermal conductor at the cryogenic temperatures of interest. Thus, stainless steel is, for this disclosure, not considered to be a thermally conductive material. Sapphire is an extremely efficient thermal conductor in this range of temperature and is a good candidate for use in bobbin 21. The intersection point 30 shows that sapphire at about 14 K has excellent thermal conductivity. If bobbin 21 is comprised of an array of sapphire elements disposed within an electrical insulator no eddy currents are generated in bobbin 21.

Figure 2A:
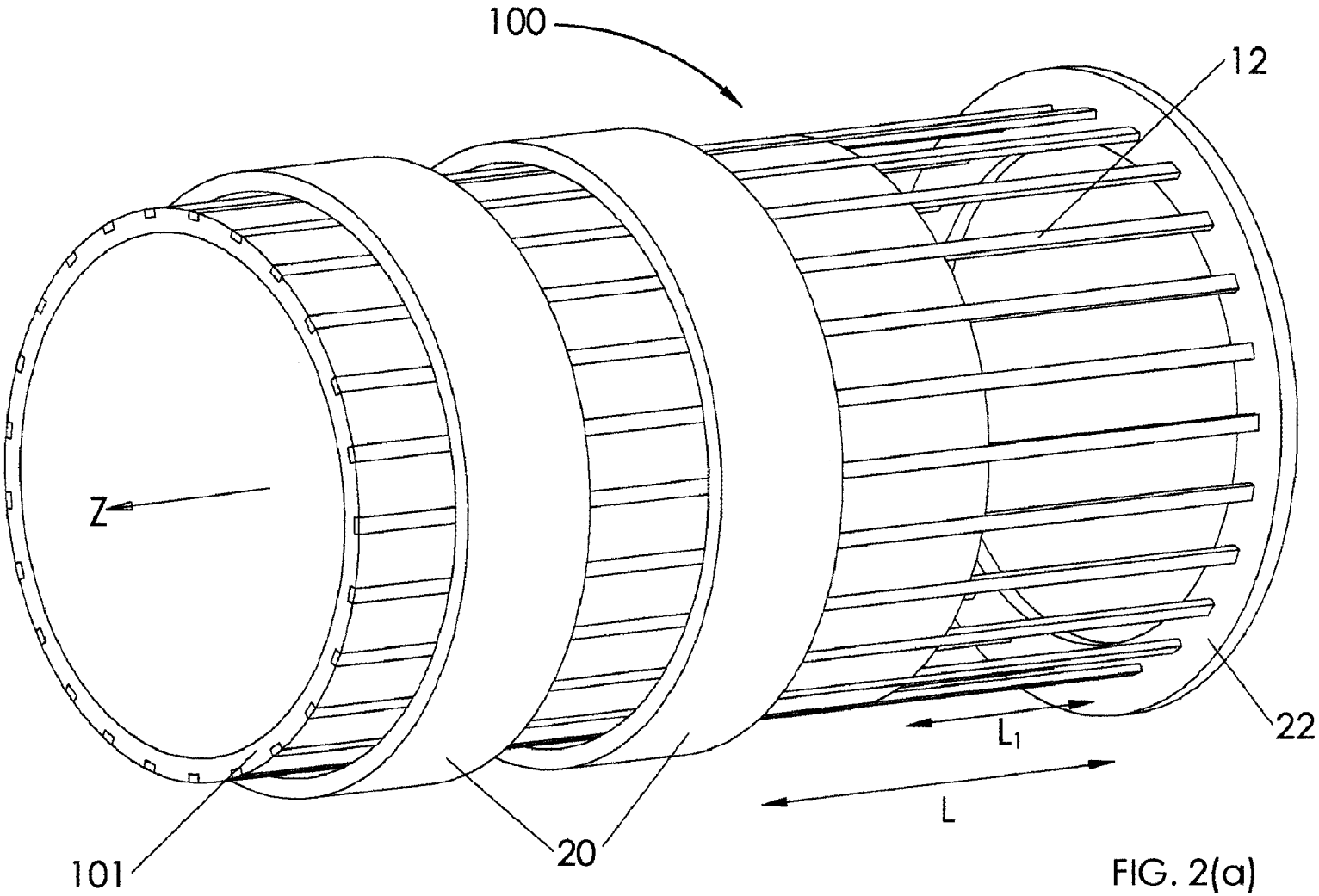
FIGS. 2(*a*) and (*b*) are isometric views of superconducting gradient coil systems in accordance with further embodiments.
Figure 2B:
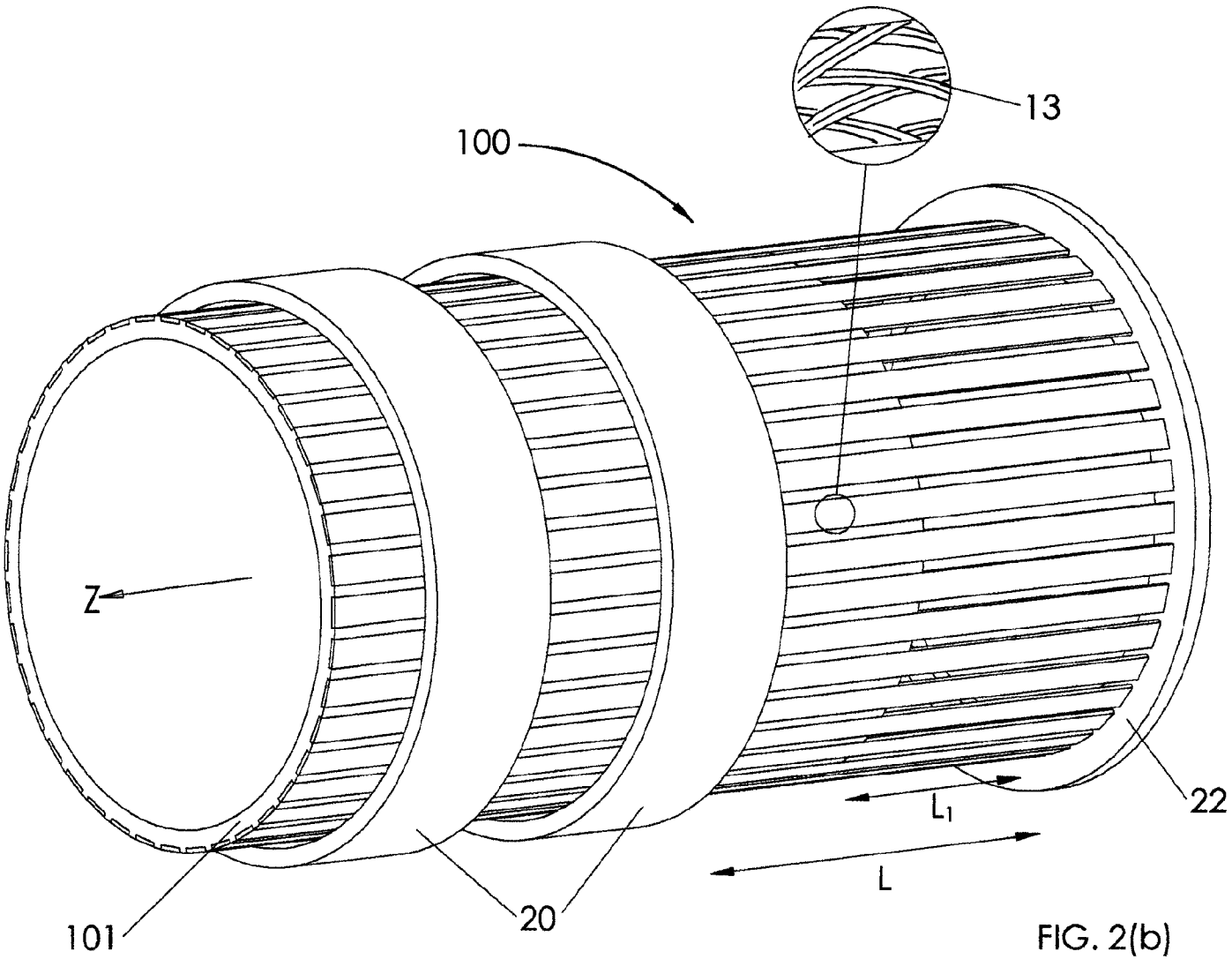

Referring to FIG. 2(*a*), an isometric view of composite bobbin 100 features an array of thermally conducting sapphire heat conducting elements 12 disposed within an electrically insulating material 101. Gradient coils 20 are disposed at specific locations along axis Z, distal from cooling plate 22. Inner diameters of coils 20 physically contact the outer surface of composite bobbin 100. At a distance L away from coils 20, heat conducting elements 12 make physical contact with cooling plate or mass 22. The extent of fill of electrically insulating material 101 along Z may be terminated at a distance $L_1$ from cooling plate 22. Distance $L_1$ may be of any length equal to or less than distance L. Termination surfaces of electrically insulating material 101 may be rough and/or non-uniform.

Another good thermal conductor candidate for using in composite bobbin 100 is Litz cable. Litz cable, for the purpose of this disclosure, is composed of electrically conducting wires (usually copper) that are individually electrically insulated and that are braided and/or cabled in one or more stages. Without being bound by a particular theory, a known benefit of Litz cable is that its configuration minimizes eddy current losses when it is exposed to a time-varying magnetic field. Any additional AC losses are to be avoided or minimized no matter how efficient the heat sink.

Referring to FIG. 2(*b*), an isometric view of composite bobbin 100 features an array of thermally conducting Litz cable elements 13 disposed within an electrically insulating material 101. Gradient coils 20 are disposed at specific locations along axis Z, distal from cooling plate 22. Inner diameters of coils 20 are in physical contact with composite bobbin 100. At a distance L away from coils 20, heat conducting elements 13 make physical contact with cooling plate or mass 22. The extent of fill of electrically insulating material 101 along Z may be terminated at a distance $L_1$ from cooling plate 22. Distance $L_1$ may be of any length equal to or less than distance L. Termination surfaces of electrically insulating material 101 may be rough and/or non-uniform.

As is apparent, refer again to FIG. 1, bobbin 21 (as composite bobbin) not only provides the structural support for coils 20 but, most importantly becomes a part of a heat conduction assemblage in physical contact with coils 20. Bonding of coils 20 (with glue, epoxy, etc.) to bobbin 21 would yield a further improvement in the thermal management of coils 20. Placement of additional Litz cable or other thermal conductor to facilitate physical contact with coil outer surfaces 200 would lead to further improvement to the heat conduction capability of the system. Bobbin 21 is shown in physical contact with another portion of the heat conduction assemblage, namely, plate or mass 22 that, in turn, is in thermal communication with cryocooler 24 via, as shown, heat conducting member 23. It is intended that heat conducting member 23 be capable of conducting tens of Watts of heat flow to the cryocooler 24. Conducting member 23 would be preferably made from copper or copper alloys or aluminum or aluminum alloys. It would be clear to those practicing this art that windings (unitary wire or cable) of coils 20 cannot make electric contact with composite bobbin 100.

With regard to image-based magnetic propulsion application, the high field strength SGC system may reside within the bore space of the DC superconducting magnet of an MRI scanner. It is known that generating time-varying high gradient fields will have a detrimental effect on the performance of the DC magnet. Therefore, shielding coils need also be incorporated into the SGC system design. As a result, bobbins to support and conduct heat away from shielding coils also need to be included in the system. Thus, for a cryogen-free, three-axis SGC system, as many as six bobbins may be required. The details of exact configuration and placement of these coils and bobbins has been studied, is known in the art and will not be detailed herein. The shielding coil bobbins would become added portions of the heat conduction assemblage. Since the time-varying high strength gradient field of an SGC system can be detrimental to instruments operating outside the periphery of the SGC, shielding coils will be useful to reduce such detrimental effect. Therefore, the inclusion of shielding coils into SGC systems will be useful for most intended applications.

Refer to Table 1. It is reasonable to postulate a system design in which: 1) the steady state heat transfer conditions maintain a 4K temperature differential between the opposite ends of the heat transfer arms, 2) that a given coil should operate at 2K below its T, to account for safe operating temperature margin and for the presence of background magnetic field, and 3) that one would use a Sumitomo RDK-415D cryocooler to cool the coil by conduction. For this set of conditions, it would be required that the coldhead of the cryocooler to be at 4K and a Nb—Ti coil to be at 8K. The cooling capability of the cryocooler would be 1.5 W (i.e. 1.5 W of heat can be removed from a pulsing Nb—Ti coil). For analogous conditions, it would be required that, using a $Nb_3Sn$ coil, the coil be at 14K and the coldhead be at 10K. The cooling capability of the same cryocooler in this case would be about 14 W. (i.e. 14 W of heat can be removed from a pulsing $Nb_3Sn$ coil.) Therefore, a $Nb_3Sn$ coil can accommodate a much wider range of pulsing conditions. Those of skill in this art recognize that the details of safe temperature margins are specific to particular applications; however, the improved efficiency, in terms of cooling capacity, of allowing an SGC to reach equilibrium at a higher temperature is clear.

TABLE 1

| Coldhead Temp. (K) | Cooling Power (W) |
|---|---|
| 4 | 1.5 |
| 6 | 4 |
| 8 | 10 |
| 10 | 14 |
| 12 | 17 |

Despite the difficulties of working with wires whose active component is brittle $Nb_3Sn$, advances in processing these materials for high field, high temperature (compared to Nb—Ti) applications continue to be made. For example, techniques for fabricating coils of fine multifilamentary (2-3 micron diameter filament), twisted (to minimize AC losses) wire having an electrical insulation coating thickness of between 0.01 and 0.05 millimeters, and use of cables, by the so-called "react then wind" process have been demonstrated. See, for example, Cryogenics Volume 46, Issues 2-3, February-March 2006, pp 191-195 (2005) [Space Cryogenics Workshop] and U.S. Pat. No. 6,510,604 B1, issued to S. Pourrahimi, which are both hereby incorporated by reference in their entirety.

The above discussion was provided to highlight the advantage of using $Nb_3Sn$ conductors to achieving higher rate of heat flow to a cryocooler in applications when pulsing SGC are required. This advantage exists for other applications where pulsing superconducting coil, or coils, are under consideration, for example in motors and generators. Also, the above discussions should not be construed such that $Nb_3Sn$ conductors are always an advantageous choice. Since Nb—Ti conductors are less expensive to purchase and are easier to use to make coils, overall economic consideration may point to selection of Nb—Ti coils. The approach of conducting heat away from pulsing superconducting coils by composite bobbin thought by this invention can be used with Nb—Ti coils.

The provided discussion focuses on the application of a class of superconductors known as Low Temperature Superconductors (LTS) with $T_c$ of lower than 16K. Classes of superconductors known as High Temperature Superconducting (HTS), and $MgB_2$ have the potential of offering operations at higher temperature than $Nb_3Sn$ conductors discussed above. However, HTS and $MgB_2$ conductors have not been adequately developed in terms of economy and availability and, therefore. are not addressed here.

Although the invention has been described with reference to several embodiments, it will be understood by one of ordinary skill in the art that various modifications can be made without departing from the spirit and the scope of the invention, as set forth in the claims.

What is claimed is:

1. A system capable of providing time-varying gradient magnetic field strength greater than 50 mT/m over a spherical volume with a diameter greater than 20 centimeters, the system comprising:

a plurality of gradient coils, each comprising superconductive conductors that, above a critical temperature $T_C$, exhibit electrical resistance; and a heat conduction assemblage, a portion of the assemblage in physical contact with each coil, such that heat generated in association with the time-varying gradient magnetic field is capable of being conducted through the assemblage and away from the conductors to achieve a steady-state system temperature below $T_C$ and thereby maintaining the conductors in a superconducting state.

2. The system of claim 1 comprising three mutually orthogonal gradient coils.

3. The system of claim 2 further comprising:

three shielding coils, such that each gradient coil has a shielding coil associated with it, thereby defining three mutually orthogonal shielded gradient coils.

4. The system of claim 1 wherein the heat conduction assemblage comprises:

a plurality of composite bobbins, each composite bobbin having a gradient coil associated therewith; each composite bobbin in physical contact with its associated gradient coil; each bobbin comprising an array of thermally conductive elements disposed within an electrical insulator; and a thermally conductive mass in physical contact with the bobbins at a distance from the coils.

5. The system of claim 4 wherein the plurality of gradient coils comprises three mutually orthogonal gradient coils, the system further comprising three shielding coils, such that each gradient coil has a shielding coil associated with it, thereby defining three mutually orthogonal shielded gradient coils, wherein the plurality of composite bobbins comprises three composite bobbins, one associated with each of the mutually orthogonal gradient coils, the system further comprising:

three shielding coil composite bobbins, each having a shielding coil associated therewith, each shielding coil composite bobbin in physical contact with its associated shielding coil; each shielding coil composite bobbin comprising an array of thermally conductive elements disposed within an electrical insulator;

such that the thermally conductive mass is also in physical contact with the shielding coil bobbins at a distance from the shielding coils.

6. The system of claim 4 wherein the thermally conductive elements comprise a plurality of Litz cables.

7. The system of claim 4 wherein the thermally conductive elements comprise sapphire.

8. The system of claim 4 wherein the thermally conductive elements have sufficient length to integrally extend from the gradient coil to the mass.

9. The system of claim 1 wherein the time-varying gradient magnetic field strength provided is greater than 200 mT/m.

10. The system of claim 1 wherein the time-varying gradient magnetic field strength provided is greater than 500 mT/m.

11. The system of claim 1 wherein the superconductive conductors comprise an A15 compound.

12. The system of claim 11 wherein the A15 compound is $Nb_3Sn$.

13. The system of claim 12 wherein the $Nb_3Sn$ conductors comprise unitary, twisted multifilamentary wires.

14. The system of claim 13 wherein filaments of the multifilamentary wires have a maximum diameter of about 10 microns.

15. The system of claim 1 wherein the superconductive conductors are twisted, multifilamentary wires that have an electrical insulating coating, the coating having a coating thickness of between 0.01 and 0.05 millimeters.

16. The system of claim 1 further comprising:

a mechanical cryocooler in thermal communication with the heat conduction assemblage, the cryocooler capable of absorbing heat being conducted away from the gradient coils to achieve a steady-state system temperature below $T_C$ and thereby maintaining the conductors in a superconducting state.

17. The system of claim 3 further comprising:

a mechanical cryocooler in thermal communication with the heat conduction assemblage, the cryocooler capable of absorbing heat being conducted away from both the gradient coils and the shielding coils to achieve a steady-state system temperature below $T_C$ and thereby maintaining the conductors in a superconducting state.

18. A system capable of providing time-varying gradient magnetic field strength greater than 50 mT/m, over a spherical volume with a diameter greater than 20 centimeters, the system comprising:

three mutually orthogonal shielded gradient coils, each comprising twisted multifilamentary $Nb_3Sn$ A15 compound wires that, above 16 K, exhibit electrical resistance;

three composite bobbins, each composite bobbin in physical contact with an associated gradient coil, each bobbin comprising an array of thermally conductive elements disposed within an electrical insulator;

three shielding coil composite bobbins, each shielding coil composite bobbin in physical contact with an associated shielding coil, each shielding coil bobbin comprising an array of thermally conductive elements disposed within an electrical insulator;

a thermally conductive mass in physical contact with the bobbins at a distance from the coils; and a mechanical cryocooler in thermal communication with the mass, the cryocooler capable of absorbing heat being conducted away from the shielded gradient coils to achieve a steady-state system temperature below 16 K and thereby maintaining the wires in a superconducting state.

19. The system of claim 18 wherein the gradient magnetic field strength provided is greater than 200 mT/m.

20. The system of claim 18 wherein the gradient magnetic field strength provided is greater than 500 mT/m.

21. The system of claim 18 wherein the thermally conductive elements comprise a plurality of Litz cables.

22. The system of claim 18 wherein the thermally conductive elements comprise sapphire.

23. A magnetic propulsion and imaging system comprising the system of claim 10.

24. A magnetic propulsion and imaging system comprising the system of claim 20.

* * * * *